US008827879B2

(12) United States Patent
Nicholas

(10) Patent No.: US 8,827,879 B2
(45) Date of Patent: Sep. 9, 2014

(54) OMNIDIRECTIONAL EXERCISE PLATFORM

(76) Inventor: Paul James Nicholas, New York, NY (US)

( * ) Notice: Subject to any disclaimer, the term of this patent is extended or adjusted under 35 U.S.C. 154(b) by 331 days.

(21) Appl. No.: 13/186,127

(22) Filed: Jul. 19, 2011

(65) Prior Publication Data

US 2013/0023391 A1 Jan. 24, 2013

(51) Int. Cl.

| | |
|---|---|
| ***A63B 21/00*** | (2006.01) |
| ***A63B 22/20*** | (2006.01) |
| ***A63B 23/035*** | (2006.01) |
| ***A63B 23/12*** | (2006.01) |
| *A63B 23/02* | (2006.01) |

(52) U.S. Cl.

CPC ..... *A63B 21/0004* (2013.01); *A63B 23/0205* (2013.01); *A63B 21/1469* (2013.01); *A63B 22/20* (2013.01); *A63B 23/0355* (2013.01); *A63B 23/1236* (2013.01)

USPC ..... 482/132; 482/131; 482/141

(58) Field of Classification Search

CPC ..... A63B 22/20; A63B 23/0211; A63B 21/0004; A63B 21/068; A63B 21/1469; A63B 2208/0219; A63B 22/203; A63B 23/0355; A63B 2208/0295; A63B 23/1236; A63B 23/0227

USPC ..... 482/44–50, 92, 131–132, 141, 148, 482/142, 129, 907; 16/9, 14, 18 R, 24–26, 16/42 R, 45, 107, 20, 21; D21/662

See application file for complete search history.

(56) References Cited

U.S. PATENT DOCUMENTS

| | | | | |
|---|---|---|---|---|
| 1,824,920 | A | 9/1931 | Novak | |
| 2,467,603 | A * | 4/1949 | Stewart | 16/26 |
| 3,401,421 | A * | 9/1968 | Aninger | 16/25 |
| 3,478,382 | A * | 11/1969 | Nosenzo | 16/44 |
| 3,752,475 | A | 8/1973 | Ott | |
| 3,809,393 | A * | 5/1974 | Jones | 482/132 |
| 4,134,584 | A * | 1/1979 | Rosenbusch | 482/93 |
| 4,171,805 | A | 10/1979 | Abbott | |
| 4,402,108 | A * | 9/1983 | Pannwitz | 16/26 |
| 4,892,305 | A | 1/1990 | Lynch | |
| 5,632,707 | A | 5/1997 | Daniel et al. | |
| 6,038,734 | A * | 3/2000 | Facchin | 16/24 |
| 6,093,159 | A | 7/2000 | Racoosin | |
| 6,942,605 | B1 * | 9/2005 | Sukhovitsky | 482/132 |

(Continued)

FOREIGN PATENT DOCUMENTS

WO WO 2007/112495 A1 * 10/2007 ..... A63B 22/20

*Primary Examiner* — Loan H Thanh
*Assistant Examiner* — Andrew S Lo
(74) *Attorney, Agent, or Firm* — Allen D. Hertz, P.A.; Allen D. Hertz

(57) ABSTRACT

An omnidirectional exercise platform is disclosed which includes a base member, a pad member and a plurality of ball transfer units. The pad member is coupled to a top surface of the base member. The plurality of ball transfer units is coupled to a bottom surface of the base member. An angular offset is provided between the plurality of ball transfer units to stabilize the omnidirectional exercise platform during use. The ball transfer units each comprise a hemispherical housing, a primary ball member and a plurality of secondary ball members disposed between an inner surface of the hemispherical housing and the primary ball member. The housing further includes an aperture located and sized to facilitate cleaning and maintenance procedures of the ball transfer unit. A handle is releasably coupled to the top surface of the base member to thereby provide a user with a variety of hand placement positions.

15 Claims, 7 Drawing Sheets

(56) References Cited

U.S. PATENT DOCUMENTS

| | | | | |
|---|---|---|---|---|
| 7,621,858 | B2 * | 11/2009 | Sheron | 482/132 |
| D631,106 | S | 1/2011 | Zemel | |
| 2003/0131444 | A1 * | 7/2003 | Koguchi | 16/24 |
| 2006/0014615 | A1 * | 1/2006 | Godbold | 482/141 |
| 2007/0184951 | A1 * | 8/2007 | James et al. | 482/141 |
| 2007/0298947 | A1 * | 12/2007 | Eksteen | 482/141 |
| 2008/0200318 | A1 | 8/2008 | Hauser et al. | |
| 2009/0298656 | A1 * | 12/2009 | Dannenberg | 482/141 |
| 2009/0305853 | A1 | 12/2009 | Jordan | |
| 2010/0004105 | A1 * | 1/2010 | Peddar | 482/132 |
| 2010/0130337 | A1 | 5/2010 | Stewart | |
| 2010/0261590 | A1 | 10/2010 | Fares | |
| 2010/0267533 | A1 * | 10/2010 | Susnjara | 482/142 |
| 2010/0317496 | A1 * | 12/2010 | Abranchess | 482/141 |
| 2011/0065555 | A1 * | 3/2011 | Moskowich | 482/141 |
| 2011/0166006 | A1 * | 7/2011 | Howard | 482/141 |
| 2012/0083396 | A1 * | 4/2012 | Aquino | 482/131 |

* cited by examiner

OMNIDIRECTIONAL EXERCISE PLATFORM

FIELD OF THE INVENTION

The present disclosure generally relates to exercise devices. More particularly, the present disclosure relates to an exercise platform that provides for omnidirectional movement of the platform while performing various exercises.

BACKGROUND OF THE INVENTION

Over the years physical exercise has grown in popularity to improve the health and physical appearance of a person and also to reduce stress. There are a many forms of physical exercise that may be employed by a person such as: strength training, aerobics, calisthenics, and plyometrics to name a few. A common strength training exercise is the traditional push-up. In performing a push-up, a user assumes a prone position, and lifts the body using the arms. Through this exercise, the weight of the body serves as the main source of resistance to the muscles, particularly the pectoralis muscles, which are used in performing the push-up. However, greater muscle training efficiency may be obtained by activating additional muscle groups while performing the push-up. This is accomplished by modifying the standard up-down motion of the push-up to include various secondary movements such as: leg raises, one-armed push-ups, various hand positions, hip raises and the like. By using such modifications, the user activates various secondary muscle groups, which in turn significantly increase the effectiveness of the physical exercise.

Additionally, exercise efficiency can be further enhanced by random activation of these secondary muscle groups, which induces muscle confusion. It is known that performing the same exercise over and over cause the human body to adapt to these exercise motions and thereby causing a diminishing return by performing the same exercise repeatedly. Consequently, by employing muscle confusion that randomly activates various secondary muscle groups during a particular exercise, the human body is less likely to adapt to the exercise motions and thus receives greater benefit from the exercise.

There are several known devices in the prior art that seek to enhance the overall effectiveness of performing various exercises and in particular the traditional push-up. These devices commonly seek to facilitate one or more secondary motions, which in turn activate additional muscle groups during the core exercise. One known solution provides a platform having base member and a handle member that rotate with respect to each other along a vertical axis. The base member has a non-slip surface that engages a floor surface and prevents the device sliding along the floor. While this known solution is somewhat useful, it presents substantial drawbacks. Firstly, this device only permits the handle member to rotate which in turn allows the arms of a user to twist during the push-up. Although this does engage some secondary muscle groups, this rotation of the hand position generally focuses on the smaller muscles of the forearm and upper arm. Secondly, this device does not permit lateral motion of the device along the floor surface and thereby fails to activate many secondary muscle groups in the shoulders, chest, and back of a person during the exercise motion.

Another known solution provides an exercising device that includes a platform and a number of peripherally spaced caster wheels underneath the platform, for supporting a limb of a user on or against a supporting surface while permitting movement of the limb in any direction along the supporting surface. The platform has a lower body part that carries the caster wheels, and a removable upper part, which can be removed or inverted to change the configuration of the upper surface of the platform. Straps are provided to secure the device to the limb of a user. While this known solution is somewhat useful, it presents substantial drawbacks. To begin, the device uses a plurality of caster wheels that must be pushed or pulled to orientate each caster in the same direction. Then when a directional change is desired, the user must apply additional force to get the plurality of casters change direction and align in the new direction. This additional force requirement induces an inconsistency in the exercise motion. Further, this device does not facilitate a smooth uniform exercise motion because the multiple casters must realign prior to changing direction. Next, this device employs casters having a wheel/ball member that is supported by thru axel coupled to the frame of the caster. This configuration is likely to have increased axle friction under load and thus does not facilitate free motion.

Various exercise devices are known that employ a plurality of ball and cup-type members coupled to a bottom surface of the device and while somewhat useful these known solutions present substantial drawbacks. In these known solutions, there is generally provided a plurality of ball members that are rotationally coupled into a hemispherical cup formed within a housing member. The ball members are free to rotate in any direction with respect to the hemispherical cup. These known solutions, while providing some benefit, have a substantial drawback of increased friction between the ball member and hemispherical cup under load conditions. This type of ball motion assembly has a substantial portion of the ball member surface area in sliding contact with the surface area of the hemispherical cup and thereby restricts the free motion of the ball with respect to the cup under load. Moreover, in these known solutions, as a user increases the load on the device the induced additional friction between the ball and cup prevent the fluid multi-directional movement of the exercise device.

In another known exercise device that provides a hemispherical support frame and a single rigid support ball mounted to the support frame with a plurality of smaller low-friction ball bearings disposed in between the support ball and the support frame such that the support ball is freely rotatable in any direction. While this known solution is somewhat useful, it presents substantial drawbacks. Most significantly, this device only provides a single support ball, which causes the hemispherical support frame to be unstable during use. As discussed above, having and exercise device that permits a user to activate secondary muscle groups is advantageous. However, the exercise device must provide a stable platform by which the exercise can be safely performed and which reduces the possibility of injuring the user. Although this known exercise device provides a platform that facilitates fluid multi-directional movement during use, this device inherently presents an increased risk of potential injury to the user. The device has a high center of rotation between the support ball and hemispherical support frame. During use, this high center of rotation is likely to cause an undesired change in direction, due to the instability of the device, which may injure the hand, wrist, foot, or ankle of a user. For example, during a push-up it is beneficial to have the freedom of motion to laterally translate the hand position of the user (i.e., left/right/fore/aft) with respect to the starting position of the hands. It is also beneficial to have the freedom of rotational movement with respect to a vertical axis normal to a supporting floor surface. However, this known device permits a freedom of rotational movement with respect to a horizontal axis parallel to the supporting floor surface. This horizontal freedom of movement causes a twisting/torquing of the wrist joint of the user, which in turn is likely to result in a significant and painful injury to the user. In another example, this known device may be used for hamstring raises where the user places their feet on the hemispherical support frame to exercise their hips, hamstrings and core. As discussed above, this known solution presents a similar risk of injury to the ankle of the user, due to the horizontal freedom of movement, which can induce an undesired twisting/torquing of the ankle joint.

Efforts to provide an omnidirectional exercise platform that overcomes the drawbacks in the prior art have not met with significant success to date. As a result, there is a need in the art for an exercise platform that provides smooth, fluid omnidirectional movement of the platform and concurrently provides a stable platform that reduces the risk of injuring the user.

SUMMARY OF THE INVENTION

The basic inventive concept provides an omnidirectional exercise platform that permits free multi-directional translation of the platform with respect to a support surface, and further permits rotational movement with respect to a vertical axis normal to the support.

From an apparatus aspect, the invention comprises an omnidirectional exercise platform for facilitating a physical training exercise. The platform includes a base member having a top surface, an opposing bottom surface and at least one sidewall disposed there between. A plurality of apertures is formed into the bottom surface of the base member and extending towards the top surface of the base member. A pad member having a top surface, an opposing bottom surface and at least one sidewall disposed there between is coupled to the top surface of the base member. Each individual ball transfer unit is coupled within one of the plurality of apertures formed into the bottom surface of the base member, such that the plurality of ball transfer units substantially reduces rolling resistance when the omnidirectional exercise platform is loaded over a support surface during the physical training exercise.

From a system aspect, an omnidirectional exercise system is disclosed comprising a pair of omnidirectional exercise platforms for facilitating a physical training exercise. Each platform includes a base member having a top surface, an opposing bottom surface and at least one sidewall disposed there between. A plurality of apertures is formed into the bottom surface of the base member and extending towards the top surface of the base member. A pad member having a top surface, an opposing bottom surface and at least one sidewall disposed there between is coupled to the top surface of the base member. Each individual ball transfer unit is coupled within one of the plurality of apertures formed into the bottom surface of the base member, such that the plurality of ball transfer units substantially reduces rolling resistance when the omnidirectional exercise platform is loaded over a support surface during the physical training exercise.

From a method aspect, a method of fabricating an omnidirectional exercise platform for facilitating a physical training exercise, comprising the steps of: providing a base member having a top surface, an opposing bottom surface and at least one sidewall disposed there between; forming a plurality of apertures into the bottom surface of the base member and extending towards the top surface of the base member; coupling a pad member to the top surface of the base member, the pad member having a top surface, an opposing bottom surface and at least one sidewall disposed there between; and coupling each individual ball transfer unit of a plurality of ball transfer units within one of the plurality of apertures formed into the bottom surface of the base member, wherein the plurality of ball transfer units substantially reduces rolling resistance when the omnidirectional exercise platform is loaded over a support surface during the physical training exercise.

For a fuller understanding of the nature and advantages of the present invention, reference should be made to the ensuing detailed description of the preferred embodiments taken in conjunction with the accompanying.

BRIEF DESCRIPTION OF THE DRAWINGS

The components in the figures are not necessarily to scale, emphasis instead being placed upon illustrating the principles of the invention. The invention will now be described, by way of example, with reference to the accompanying drawings, in which.

In the figures, like reference numerals designate corresponding elements throughout the different views of the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

Figure 1:
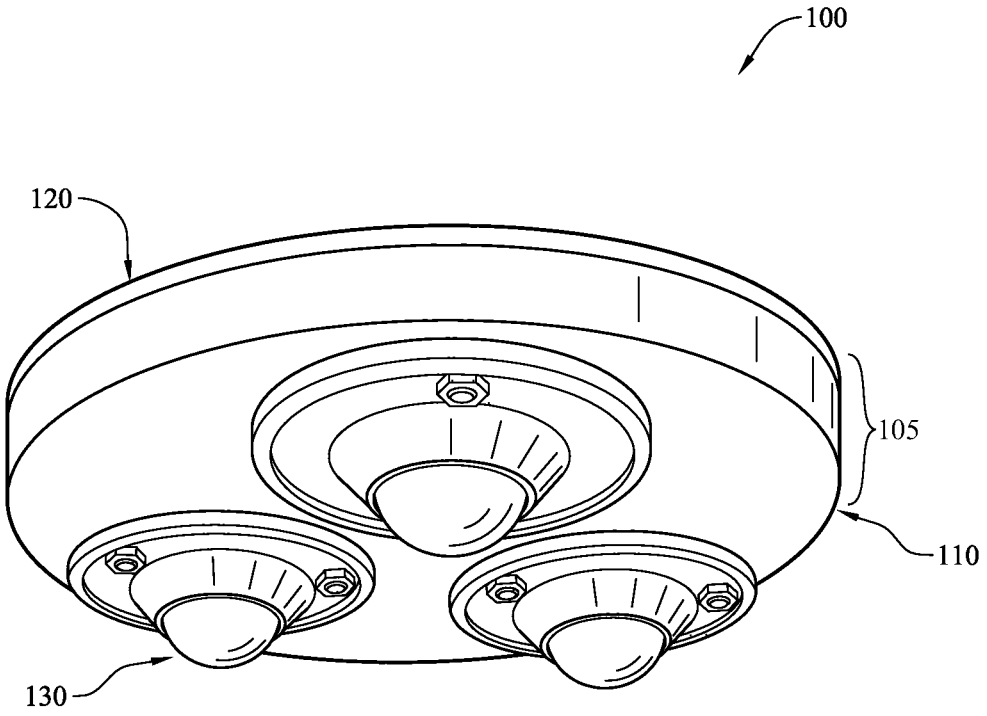
FIG. 1 is a perspective view of an exemplary embodiment of an omnidirectional exercise platform in accordance with the present invention.
Figure 2:
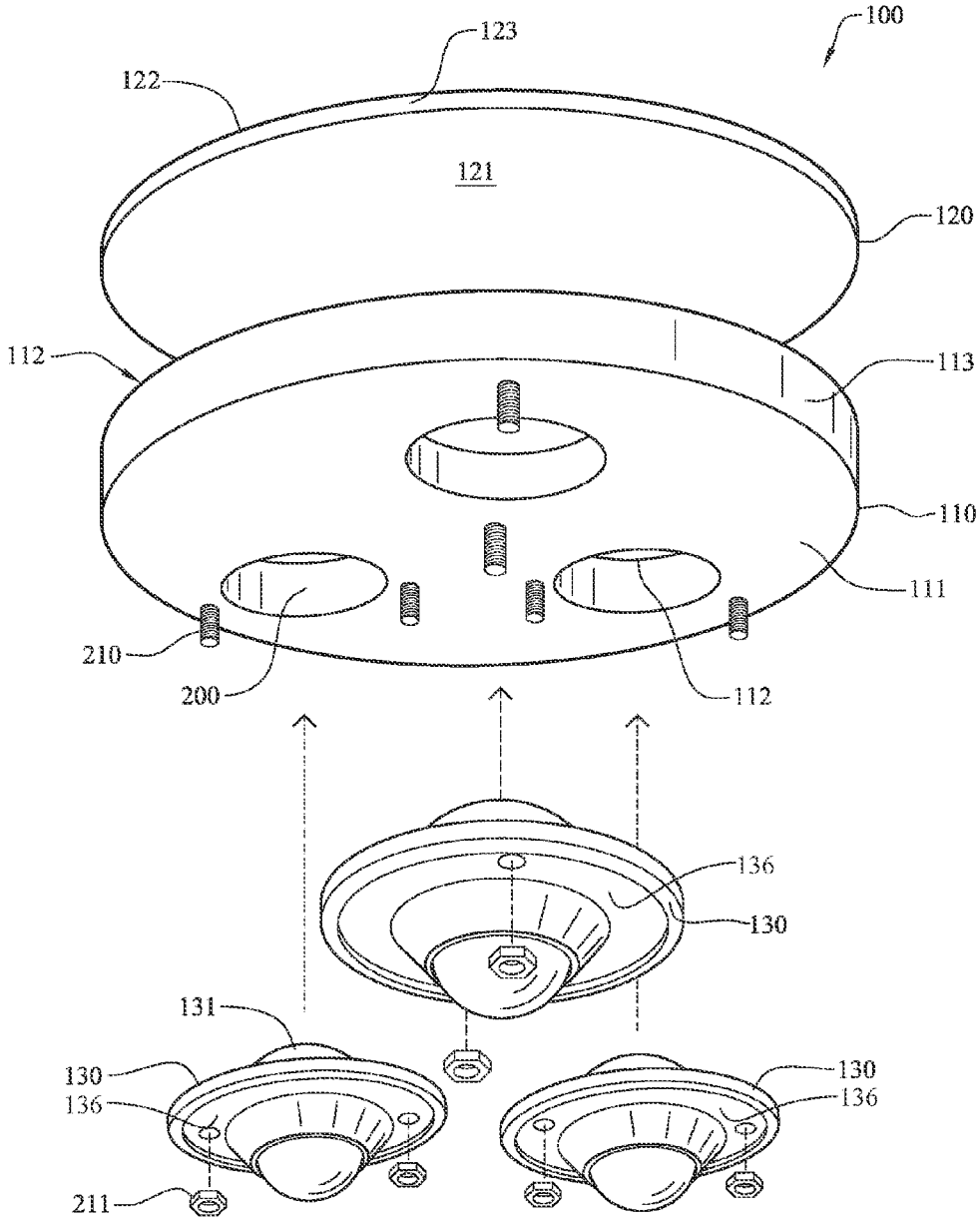
FIG. 2 is an exploded perspective view of the exemplary embodiment of FIG. 1 in accordance with the present invention.
Figure 3:
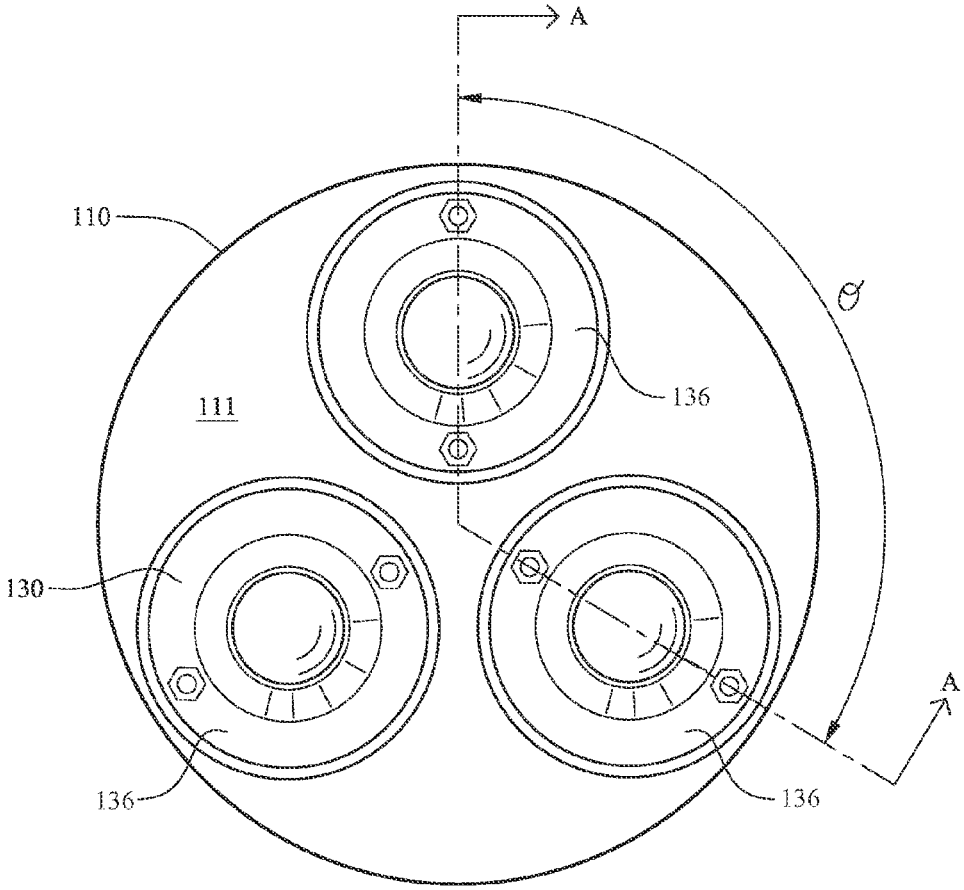
FIG. 3 is a bottom view of the exemplary embodiment of FIG. 1 illustrating Section Line A-A in accordance with the present invention.

Reference is now made to FIGS. 1 and 2, which show an exemplary embodiment of an omnidirectional exercise platform 100. Omnidirectional exercise platform 100 includes a a base member 110, a pad member 120 and a plurality of ball transfer units 130. In one exemplary embodiment, base member 110 comprises a bottom surface 111, an opposite top surface 112, and at least one sidewall 113 disposed there between. Base member 110 may be fabricated from a rigid material such as plastic, wood, metal or combinations thereof. There are several well-known manufacturing processes that may be employed to fabricate base member 110 such as but not limited to: casting, injection molding, machining, stamping, carving and vacuum forming. It is noted that one of ordinary skill in the art would readily appreciate these various manufacturing processes, which are not described in detail herein so as not to obscure the invention. Base member 110 is shown in a generally circular shape; however, other geometric profile configurations are contemplated such as oval, triangular, multi-sided polygons, etc. Formed into bottom surface 112 is a plurality of apertures 200, wherein each aperture 200 is configured to accept a portion of a housing 131 of a respective ball transfer unit 130 therein. Ball transfer units 130 are secured to base member 110 by passing one or more mechanical fasteners such as a screw 210 through an aperture of a mounting feature 136 of ball transfer unit 130 and a corresponding aperture in base member 110, and a nut 211. It is contemplated that ball transfer units 130 may be coupled to base member 110 by other mechanical configurations/means such as press fit, snap-ring, adhesive bonding or combinations thereof. Pad member 120 includes a bottom surface 121, an opposite top surface 122 and at least one sidewall 123 disposed there between. Pad member 120 may be fabricated from a pliant or semi-rigid plastic or polymer material to provide a cushioned engage surface to enhance user comfort and grip during use. In one embodiment, pad member 120 is fabricated from neoprene rubber. Bottom surface 121 of pad member 120 is coupled to the top surface 112 of base member 110 by various known mechanical means such as: adhesive, snaps, buttons, clips, clasps, press fit, or hook/loop fasteners Attention is now directed to FIG. 3, which is a bottom view of the omnidirectional exercise platform 100 and illustrating an angular offset θ between the ball transfer units 130. In this exemplary embodiment, base member 110 is configured as a circular structure. To provide a stable platform in use, ball transfer units 130 are preferably arranged to have an angular offset θ that equals about 120 degrees. For this example, the angular offset θ was determined by dividing 360 degrees by the number of ball transfer units 130 being used. Should one of ordinary skill in the art desire to use more ball transfer units 130, the angular offset θ would be adjusted accordingly (e.g., 4 ball transfer units would have an angular offset θ of 90 degrees). In other alternate embodiments having different geometric configurations, the ball transfer units 130 may be arranged differently. It is contemplated that the location of the plurality of ball transfer units 130 preferably be selected such that base member 110 stability is enhanced/maintained during use. For example, in an alternate embodiment where base member 110 is configured as an oval, there would be 4 ball transfer units 130 employed with one ball transfer unit 130 located along and adjacent to each end of the minor and major axis. In another alternate embodiment where base member 110 is configured as a square there would preferably be a ball transfer unit 130 located adjacent each corner or side of the square.

Figure 4:
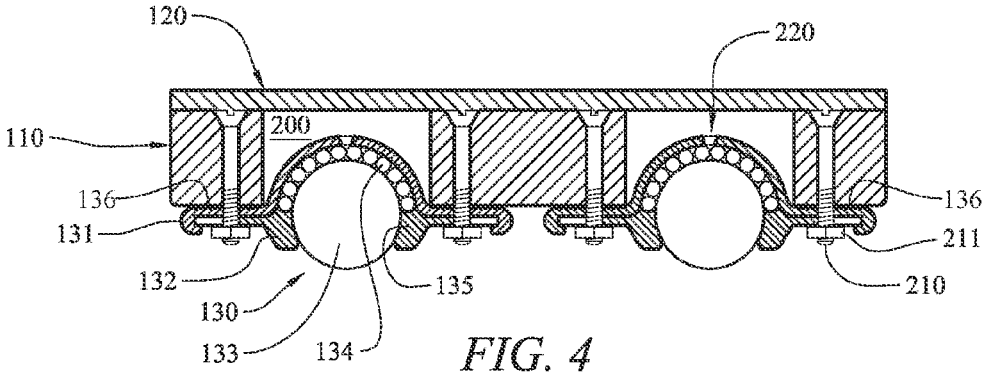
FIG. 4 is a cross-section view taken along Section Line A-A of FIG. 3 in accordance with the present invention.

A cross-sectional view of the omnidirectional exercise platform 100 is illustrated in FIG. 4 showing two (2) ball transfer units 130 coupled to base member 110 using screws 211 and nuts 210. Ball transfer unit 130 generally comprises a housing 131, a retention member 132, a primary ball member 133, a plurality of secondary ball members 134 and a retention ring 135. In one exemplary embodiment, aperture 200 is sized and configured to accept therein a hemispherical portion of housing 131. Housing 131 and retention member 132 are coupled together to form a cavity for retaining primary and secondary ball members therein. Further, housing 131 and retention member 132 may be coupled using various manufacturing processes such as crimping, press fit, adhesive bonding, mechanical fasteners and other well known element coupling processes. Captured between housing 131 and retention member 132 are a plurality of secondary ball members 134, a primary ball member 133 and a retention ring 135. Secondary ball members 134 engage a concave inner surface of housing 131. Primary ball member 133 is disposed within housing 131 and engages the opposing surfaces of the secondary ball members 134. Retention ring 135 is disposed around primary ball member 133 and retains secondary ball members 134 within the concave region of hemispherical housing 131. Retention member 132 captures the retention ring 135, secondary ball members 134 and primary ball member 133 to complete an operative ball transfer unit 130 assembly.

The ball transfer unit 130 configuration disclosed herein permits rapid omnidirectional movement of the primary ball member 133 with significantly reduced friction under high load conditions. The reduced friction and smooth omnidirectional movement provided by ball transfer unit 130 is enabled by reducing the contact surface area between the primary ball member 130 and the concave inner surface of housing 131. The reduction of this dynamic surface contact area is primarily effectuated by employing a plurality of secondary ball members 134 which provide both a load path and dynamic moving contact point between the primary ball member 130 and the concave inner surface of housing 131.

In one exemplary embodiment, housing 131 is configured with one or more apertures 220 formed there through. The size and location of apertures 220 may vary depending on the style of ball transfer unit 130 employed. Aperture 220 provides a means for cleaning and maintaining the ball transfer unit 130 and thereby extending the operational lifespan of the ball transfer unit 130. In one embodiment, aperture 220 may be sized such that internal contaminants such as dust, dirt, lint, fibers, fluid and the like may be permitted to pass through aperture 220 and out of housing 131. In this embodiment, aperture 220 may be sized slightly smaller that secondary ball members 134 but large enough to provide access to the inner surface of housing 131 to thereby facilitate cleaning and lubricating procedures.

Both the housing 131 and retention member 132 may be fabricated from various structural materials capable of providing adequate performance for a given load range. In one exemplary embodiment, housing 131 and retention member 132 are fabricated from stainless steel. Alternatively, housing 131 and retention member 132 may be fabricated from a zinc plated metal sheet. It is contemplated that primary and secondary ball members 133, 134 be precision ground and heat-treated such that surface imperfections and friction between the ball members are minimized. Retention ring 135, in one embodiment, is fabricated from polymer having high lubricity characteristics such as DELRIN® which is a well-known material used in component manufacturing. However, there are many suitable materials that may be employed and one of ordinary skill in the art would readily understand the various material substitutions.

In one exemplary embodiment the primary ball member 133 and/or secondary ball members 134 may be fabricated from various materials such as stainless steel, metal alloys, Teflon, nylon, polymers, composites, ceramics or combinations thereof. It is contemplated that that primary ball member 133 may be selected from a material that prevents adversely marking, scuffing or scratching a floor support surface such as hardwood or tile.

Figure 5:
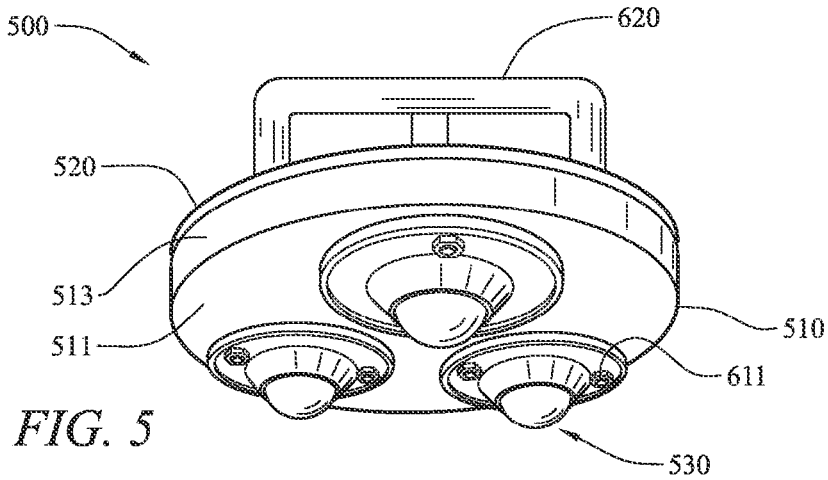
FIG. 5 is a perspective view of an exemplary alternate embodiment of an omnidirectional exercise platform further including a detachable handle in accordance with the present invention.
Figure 6:
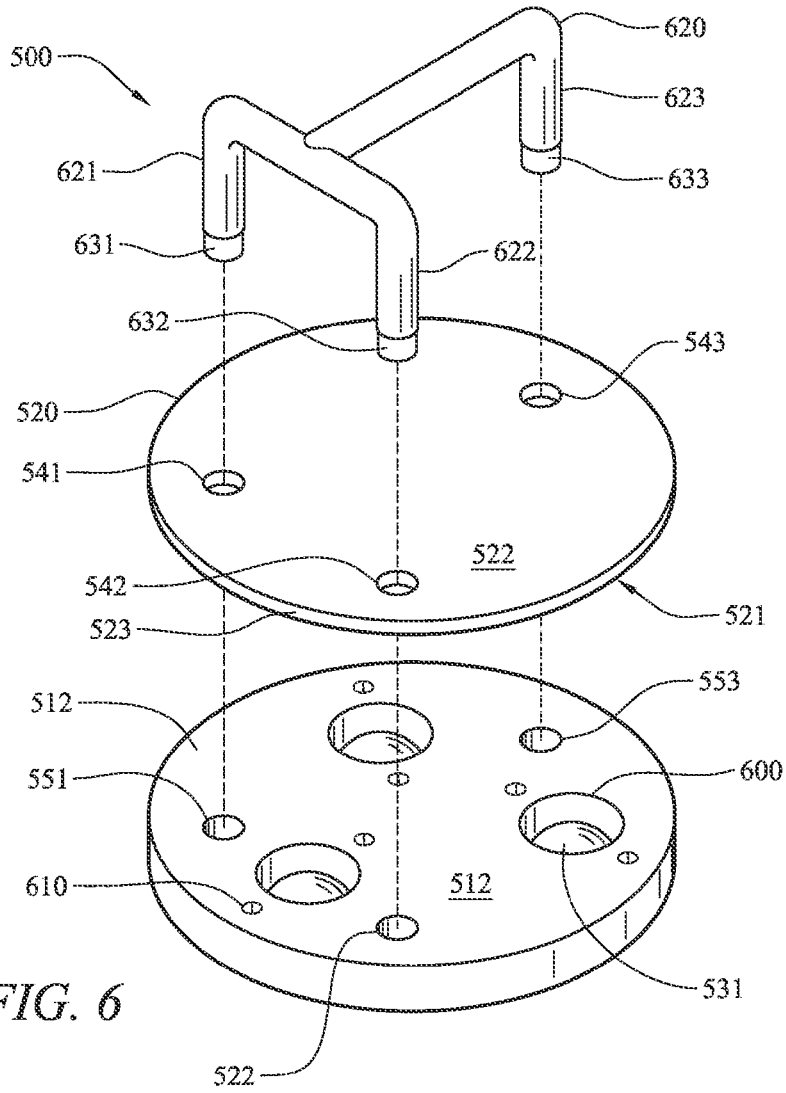
FIG. 6 is an exploded perspective view of the exemplary alternate embodiment of FIG. 5 in accordance with the present invention.

Reference is now made to FIGS. 5 and 6, which show an alternate exemplary embodiment of an omnidirectional exercise platform 500. Omnidirectional exercise platform 500 includes a base member 510, a pad member 520 and a plurality of ball transfer units 530. In one exemplary embodiment, base member 510 comprises a bottom surface 511, an opposing top surface 512, and at least one sidewall 513 disposed there between. Base member 510 may be fabricated from a rigid material such as plastic, wood, metal or combinations thereof. There are several well known manufacturing processes that may be employed to fabricate base member 510 such as, but not limited to: casting, injection molding, machining, stamping, carving and vacuum forming. It is noted that one of ordinary skill in the art would readily appreciate these various manufacturing processes, which are not described in detail herein so as not to obscure the invention. Base member 510 is shown in a generally circular shape; however, other geometric profile configurations are contemplated such as oval, triangular, multi-sided polygons, etc. Formed into bottom surface 512 is a plurality of apertures 600 that are configured to accept a portion of a housing 531 of ball transfer units 530 therein. Ball transfer units 530 are secured to base member 510 by one or more mechanical fasteners such as a screw 610, which passes through a corresponding aperture in base member 510, and nut 611. It is contemplated that ball transfer units 530 may be coupled to base member 510 by other mechanical configurations/means such as press fit, snap-ring, adhesive bonding or combinations thereof. Pad member 520 includes a bottom surface 521, an opposing top surface, 522 and at least one sidewall 523 disposed there between. Pad member 520 may be fabricated from a pliant or semi-rigid plastic or polymer material to provide a cushioned engage surface to enhance user comfort and grip during use. In one embodiment, pad member 520 is fabricated from neoprene rubber. Bottom surface 521 of pad member 520 is coupled to the top surface 512 of base member 510 by various known mechanical means such as: adhesive, snaps, buttons, clips, clasps, press fit, or hook/loop fasteners.

The alternate exemplary embodiment illustrated in FIGS. 5 and 6, further includes a T-shaped handle 620 having three bollards 621, 622, 623 that extend downward from handle 620. It is contemplated that handle 620 be configured for releasable coupling with omnidirectional exercise platform 500 by having a distal end 631, 632, 633 of bollards 621, 622, 623 pass through a respective aperture 541, 542, 543 formed in pad member 520. The distal ends 631, 632, 633 of bollards 621, 622, 623 then press fit into respective cavities 551, 552, 553 formed into top surface 512 of base member 510. In this embodiment, handle 620 provides a user, of the omnidirectional exercise platform 500, with the added feature of being able to employ a closed first grip while performing a desired exercise. It is contemplated that handle 620 may be fabricated using various manufacturing processes (e.g., injection molding, casting, machining) and materials (e.g., metal alloys, plastics, resins) that one of ordinary skill in the art would readily appreciate. In another variation, distal end 631, 632, 633 of bollards 621, 622, 623 may be releasably coupled to cavities 551, 552, 553 by any one of several mechanical coupling means such as: snap fit, retention screws/pins (not show), or magnets. It is further contemplated that handle 620 may be configured in other geometric shapes such as: an I-shape, an L-shape etc., and one of ordinary skill in the art would easily understand adapting such shapes for releasable coupling with omnidirectional exercise platform 500. Bollards 621, 622, 623 provide a dimensional offset between handle 620 and the top surface 522 of pad member 520. For example, an I-shaped handle may be employed by reducing the number of bollards to two and providing respective apertures and cavities for mating with omnidirectional exercise platform 500. It is further contemplated that handle 620 may be configured with a textured surface to enhance gripping during use.

Figure 7:
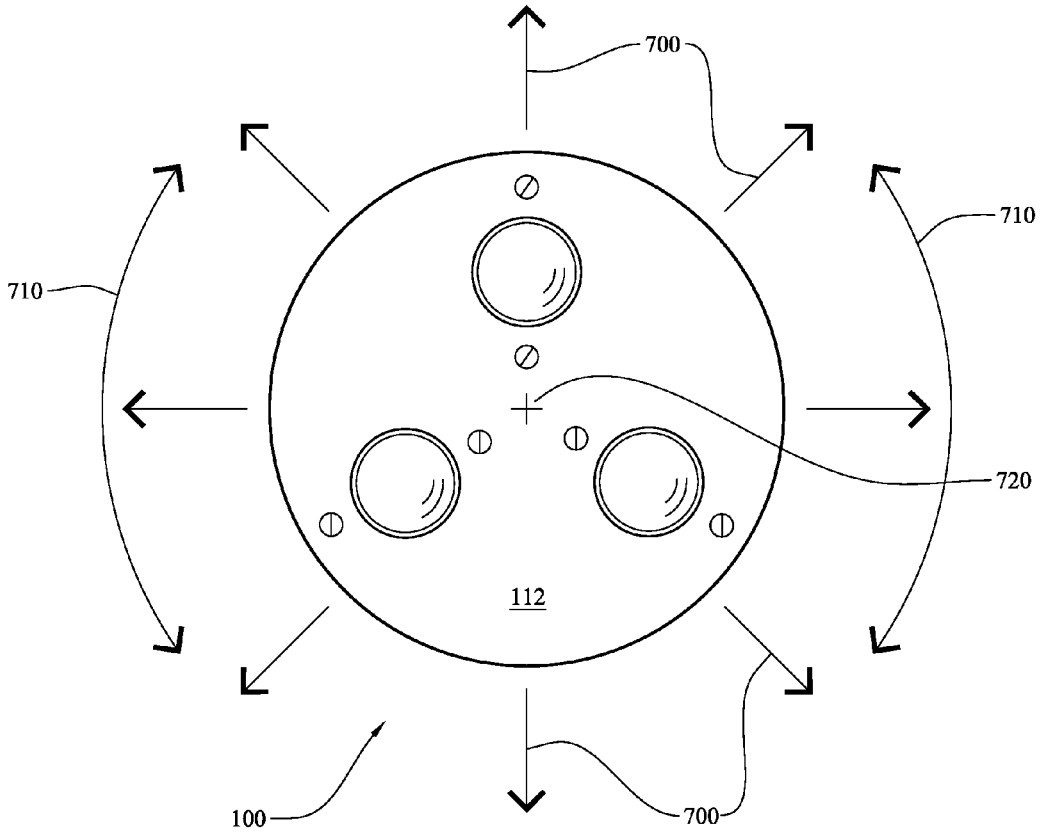
FIG. 7 is a top view of the exemplary embodiment of FIG. 1 further illustrating omnidirectional motion lines in accordance with the present invention.
Figure 8:
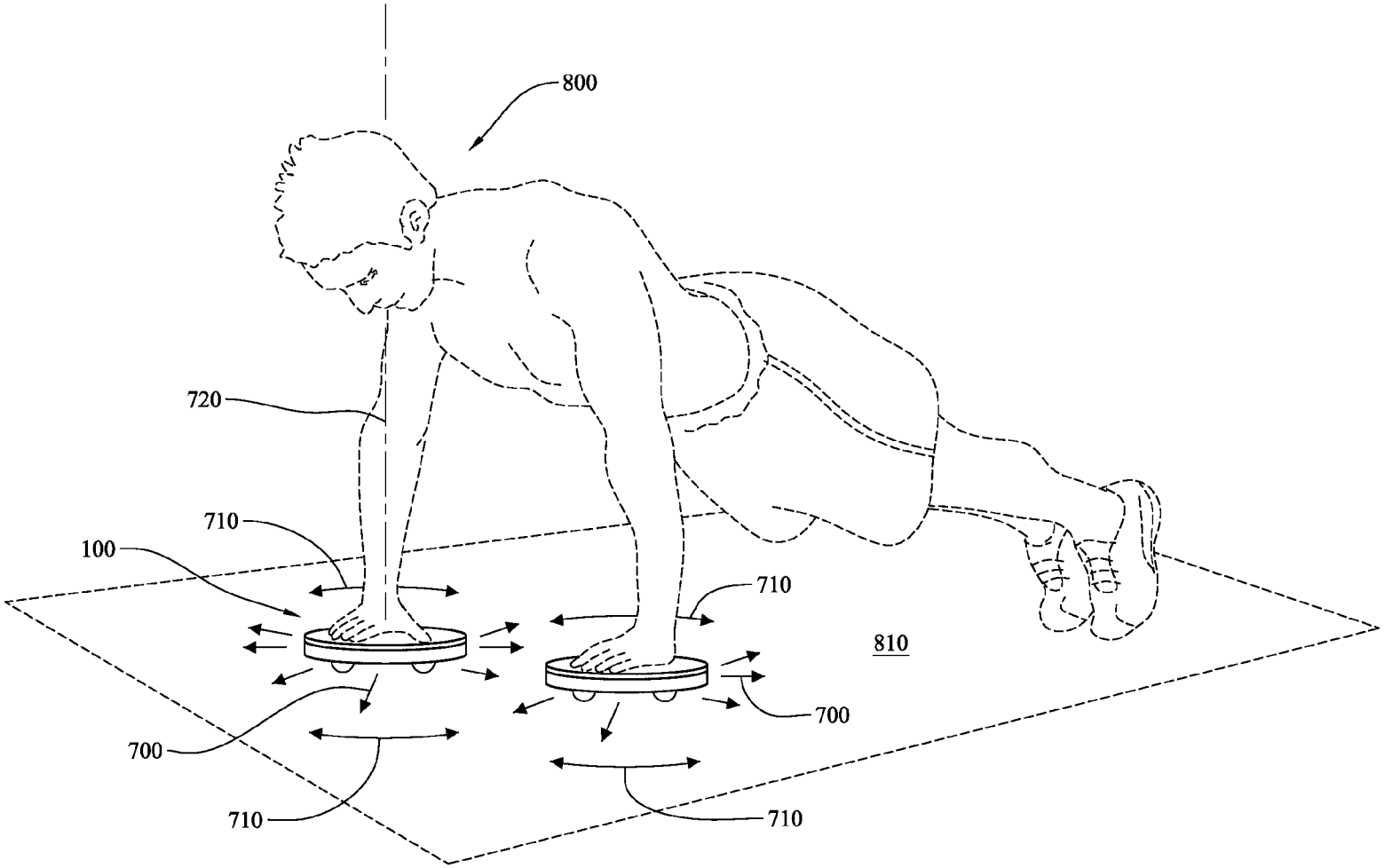
FIG. 8 is a perspective view of the exemplary embodiment of FIG. 1 in use during a push-up in accordance with the present invention.

In use, and referring to FIGS. 7 and 8, omnidirectional exercise platform 100 provides a user 800 with a device that substantially enhances and activates additionally muscle groups during a push-up type exercise. The top view of omnidirectional exercise platform 100, as shown in FIG. 7, clearly indicates various omnidirectional motion lines in accordance with the present invention. In particular, FIG. 7 illustrates two types of omnidirectional motion lines. The first being, co-planar lines 700 that show exemplary translative motion paths that omnidirectional exercise platform 100 may freely move along during use. Co-planar lines 700 are generally co-planar with a support surface 810 (see FIG. 8) on which omnidirectional exercise platform 100 is placed. The second type of omni-directional motion lines are rotational lines 710 and illustrate the ability of omnidirectional exercise platform 100 to rotate or twist about an axis 720 that is normal (i.e., perpendicular) to the support surface 810 and passes through the rotational center of omnidirectional exercise platform 100.

During the execution of a physical exercise such as a push-up, illustrated in FIG. 8, the hands of a user 800 are placed on top of omnidirectional exercise platform 100 while the user 800 is in a prone position (not shown). As the user 800 begins the push-up exercise, the user 800 contracts various primary muscle groups to raise the body of the user 800 away from support surface 810 and from a prone position into an end position as shown in FIG. 8. While the user 800 is performing the push-up, the pair of omnidirectional exercise platforms 100 is free to translate along support surface 810 and also rotate about axis 720. In response to the translation/rotation of omnidirectional exercise platform 100, the user 800 must activate various secondary muscle groups to maintain the initial position of omnidirectional exercise platform 100. Alternatively, user 800 may intentionally desire a translation/rotation movement of omnidirectional exercise platform 100 to enhance the push-up exercise and thereby engage additional primary and secondary muscle groups to effectuate such movement.

Figure 9:
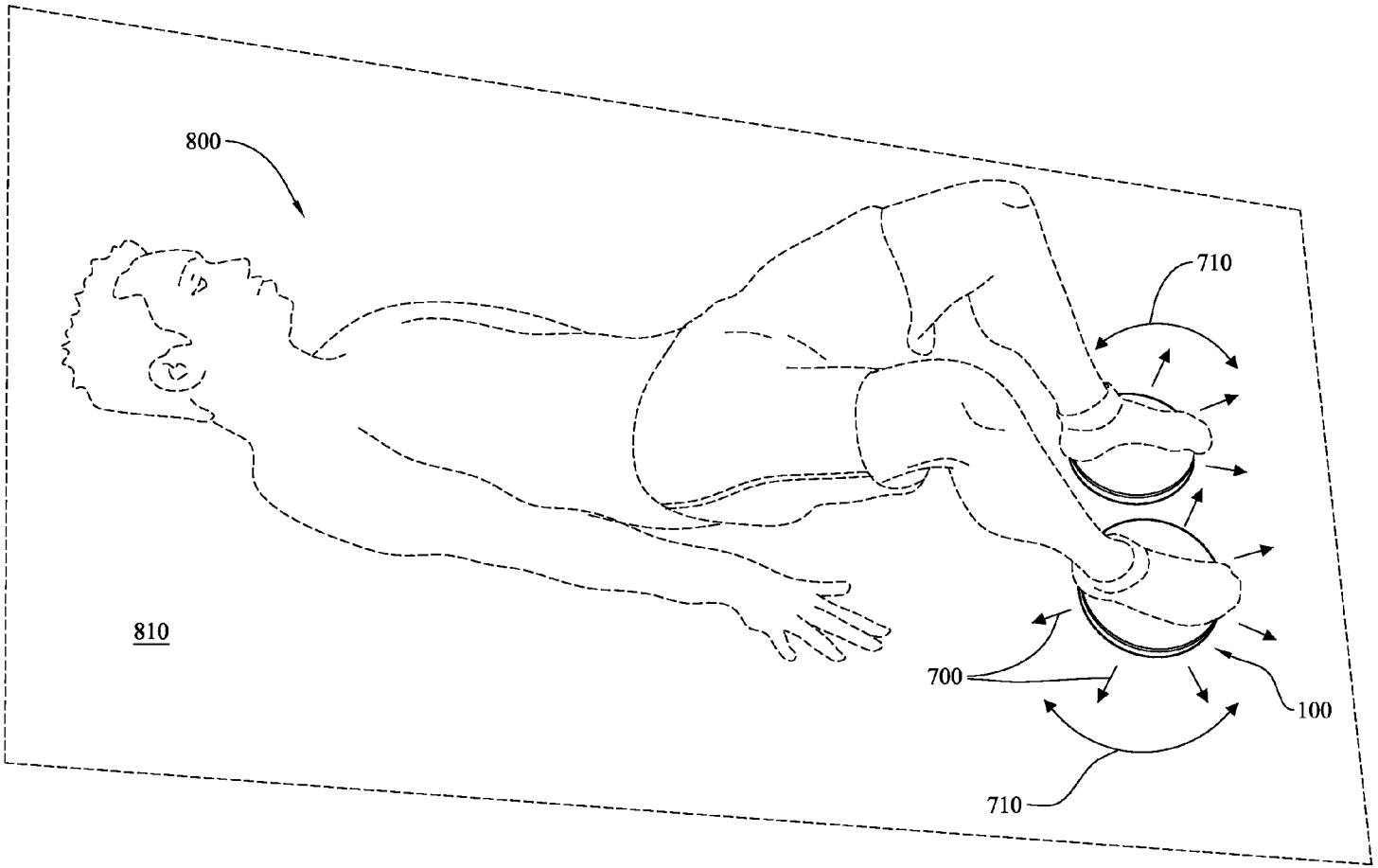
FIG. 9 is a perspective view of the exemplary embodiment of FIG. 1 in use during a hamstring raise in accordance with the present invention.

Directing attention to FIG. 9, which illustrates another physical exercise that may be performed using the omnidirectional exercise platform 100 in accordance with the present invention. This exercise is commonly referred to as a hamstring raise. Generally, a hamstring raise is employed to activate primary muscle groups of the legs and back by raising the body of user 800 from an initial position to a raised position. During a hamstring raise, the feet of a user 800 are placed onto the tops of omnidirectional exercise platforms 100. Similar to the push-up, described above, the user 800 contracts various primary muscle groups to raise the body of the user 800 away from a support surface 810 and from an initial position (not shown) into a raised position as shown in FIG. 9. While the user 800 is performing the hamstring raise, the pair of omnidirectional exercise platforms 100 is free to translate along support surface 810 and also rotate about axis 720 (shown in FIG. 8). In response to the translation/rotation of omnidirectional exercise platforms 100, the user 800 must activate various secondary muscle groups to maintain the initial position of omnidirectional exercise platforms 100. Alternatively, user 800 may intentionally desire a translation/rotation movement of omnidirectional exercise platforms 100 to enhance the hamstring raise exercise and thereby engage additional primary and secondary muscle groups.

It is understood that the omnidirectional exercise platform 100 can enable the user to complete any of a variety of additional exercises.

As will be now apparent to those skilled in the art, omnidirectional exercise platform fabricated according to the teachings of the present invention are capable of substantially enhancing one or more physical exercises of a person. Since the present invention provides an omnidirectional exercise platform that permits free multi-directional translation of the platform with respect to a support surface while performing an exercise and correspondingly requires the user to activate secondary muscle groups to prevent undesired movement of the omnidirectional exercise platform. In addition, the invention provides a platform that further permits rotational movement with respect to a vertical axis normal to the support surface. Importantly, the present invention provides a stable platform that reduces the risk of injuring the various joints (e.g., wrists & ankles) of the user. Specifically, with the present invention, it is possible to perform various physical exercises that engage a multitude of secondary muscle groups while simultaneously providing a stable surface that substantially prevents undesired twisting/torquing of delicate joints of the user. Finally, the invention provides a device that may be adapted by a user to employ different handgrip positions during an exercise.

Although the above provides a full and complete disclosure of the preferred embodiments of the invention, various modifications, combinations, alternate constructions and equivalents will occur to those skilled in the art. For example, although the invention has been described with reference to coupling the padded member to the base member, alternatively the padded member may be configured for easy removal to facilitate cleaning/replacement. Further, the invention has been described with reference to using individual ball transfer units that are coupled to the base member, these components may be permanently coupled or integrally formed therewith. It is intended that all matters in the foregoing description and shown in the accompanying drawings be interpreted as illustrative and not in a limiting sense. Therefore the above should not be construed as limiting the invention, which is defined by the appended claims and their legal equivalence.

What is claimed is:

1. An omnidirectional exercise platform for facilitating a physical training exercise, comprising:

a base member having a thickness bound by a sidewall and extending between a top surface and an opposite bottom surface and a plurality of ball transfer unit receiving apertures arranged in a spaced apart relationship, each ball transfer unit receiving aperture passing through said thickness of said base member, extending from said bottom surface of said base member through said top surface of said base member;

a pad member having a top surface, an opposite bottom surface and at least one sidewall disposed there between, said pad member bottom surface being mechanically joined to said base member top surface to provide rotational unison; and a plurality of ball transfer units, each ball transfer unit comprising a primary ball member omnidirectionally retained with a hemispherical housing by a retention member and a mounting feature extending radially outward from the hemispherical housing, an upper half of each ball transfer unit being inserted within each respective ball transfer unit receiving aperture of said plurality of ball transfer unit receiving apertures formed into said bottom surface of said base member and an exposed portion of said primary ball member extending downward, wherein said top surface of said pad member defines an uppermost portion of said omnidirectional exercise platform, thus enabling a user unencumbered access by one of a user's hand or a user's foot to said top surface of said pad member, wherein lower tangents of each of said plurality of said primary ball members form a supporting plane for omnidirectional motion of said omnidirectional exercise platform over a support surface during said physical training exercise.

2. The omnidirectional exercise platform as recited in claim 1, further comprising an angular offset between said plurality of ball transfer units.

3. The omnidirectional exercise platform as recited in claim 2, wherein said angular offset is about 120 degrees.

4. The omnidirectional exercise platform as recited in claim 1, said plurality of ball transfer units further comprising:

a plurality of secondary ball members and a retention ring;

wherein said plurality of secondary ball members are disposed between an inner surface of said hemispherical housing and said primary ball member, said retention ring disposed around each respective primary ball member to capture said secondary ball members between said inner surface of said hemispherical housing and said retention ring, and wherein said retention member is coupled to said hemispherical housing such that said secondary ball members, said primary ball member, and said retention ring are retained there between.

5. The omnidirectional exercise platform as recited in claim 4, further comprising at least one hemispherical housing aperture formed through said hemispherical housing, wherein said at least one hemispherical housing aperture is configured to permit escape of a debris entrapped within said hemispherical housing.

6. An omnidirectional exercise system for facilitating a physical training exercise, comprising:

a pair of omnidirectional exercise platforms, each of said platforms comprising:

a base member having a thickness bound by a sidewall and extending between a top surface and an opposite bottom surface and a plurality of apertures arranged in a spaced apart relationship, each aperture passing through said thickness of said base member, extending from said bottom surface of said base member through said top surface of said base member;

a pad member having a top surface, an opposite bottom surface and at least one sidewall disposed there between, said pad member bottom surface being mechanically joined to said base member top surface to provide rotational unison; and a plurality of ball transfer units, each ball transfer unit comprising a primary ball member omnidirectionally retained with a hemispherical housing by a retention member and a mounting feature extending radially outward from the hemispherical housing, an upper half of each ball transfer unit being inserted within each respective aperture of said plurality of apertures formed into said bottom surface of said base member and an exposed portion of said primary ball member extending downward, wherein said top surface of each said pad member defines an uppermost portion of each said omnidirectional exercise platform, thus enabling a user unencumbered access by one of a user's hand or a user's foot to each said top surface of each said respective said pad member, wherein lower tangents of each of said plurality of said primary ball members form a supporting plane for omnidirectional motion of said omnidirectional exercise platform over a support during said physical training exercise.

7. The omnidirectional exercise system as recited in claim 6, further comprising an angular offset between said plurality of ball transfer units of each of said platforms.

8. The omnidirectional exercise system as recited in claim 7, wherein said angular offset is about 120 degrees.

9. The omnidirectional exercise system as recited in claim 6, said each of said plurality of ball transfer units of each of said platforms further comprising:

a plurality of secondary ball members and a retention ring;

wherein said plurality of secondary ball members are disposed between an inner surface of said hemispherical housing and said primary ball member, said retention ring disposed around each respective primary ball member to capture said secondary ball members between said inner surface of said hemispherical housing and said retention ring, and wherein said retention member is coupled to said hemispherical housing such that said secondary ball members, said primary ball member, and said retention ring are retained there between.

10. The omnidirectional exercise system as recited in claim 9, further comprising at least one hemispherical housing aperture formed through said hemispherical housing, wherein said at least one hemispherical housing aperture is configured to permit escape of a debris entrapped within said hemispherical housing.

11. A method of fabricating an omnidirectional exercise platform for facilitating a physical training exercise, comprising steps of:

providing a base member having a thickness bound by a sidewall and extending between a top surface and an opposite bottom surface;

forming a plurality of spaced apart apertures through said base member, each aperture extending from said bottom surface of said base member through said top surface of said base member;

arranging in a spaced apart relationship, each aperture passing through said thickness of said base member, extending from said bottom surface of said base member through said top surface of said base member;

providing a pad member having a top surface, an opposite bottom surface and at least one sidewall disposed there between;

mechanically coupling said bottom surface of said pad member to said top surface of said base member providing rotational unison has been replaced with—to provide rotational unison; and obtaining a plurality of ball transfer units, each ball transfer unit comprising a primary ball member omnidirectionally retained within a hemispherical housing by a retention member, each ball transfer unit comprising a mounting feature extending radially outward from the hemispherical housing;

inserting an upper portion of said housing into a respective aperture of said plurality of apertures formed in said bottom surface of said base member;

abutting each of said mounting feature against said base member bottom surface;

securing each of said plurality of ball transfer units to said base member;

defining a supporting plane by a plurality of lower tangent points of each primary ball member of said plurality of ball transfer units; and defining an uppermost portion of said omnidirectional exercise platform as being said pad member upper surface, thus enabling unencumbered access by one of a user's hand or a user's foot.

12. The method of fabricating an omnidirectional exercise platform as recited in claim 11, further comprising a step of establishing an angular offset between said plurality of ball transfer units.

13. The method of fabricating an omnidirectional exercise platform as recited in claim 12, wherein said angular offset is about 120 degrees.

14. The method of fabricating an omnidirectional exercise platform as recited in claim 11, further comprising steps of:

configuring said plurality of ball transfer units with a plurality of secondary ball members and a retention ring;

disposing said plurality of secondary ball members between an inner surface of said hemispherical housing and said primary ball member;

disposing said retention ring around said primary ball member to capture said secondary ball members between said inner surface of said hemispherical housing and said retention ring; and coupling said retention member to said hemispherical housing such that said secondary ball members, said primary ball member and said retention ring are retained there between.

15. The method of fabricating an omnidirectional exercise platform as recited in claim 14, further comprising a step of forming at least one aperture formed through said hemispherical housing, wherein said at least one aperture is configured to permit escape of a debris entrapped within said hemispherical housing.

* * * * *